US008847729B2

(12) United States Patent
Moore et al.

(10) Patent No.: US 8,847,729 B2
(45) Date of Patent: Sep. 30, 2014

(54) JUST IN TIME VISITOR AUTHENTICATION AND VISITOR ACCESS MEDIA ISSUANCE FOR A PHYSICAL SITE

(75) Inventors: David P. Moore, Burleigh Waters (AU); Craig Pearson, Varsity Lakes (AU)

(73) Assignee: International Business Machines Corporation, Armonk, NY (US)

( * ) Notice: Subject to any disclaimer, the term of this patent is extended or adjusted under 35 U.S.C. 154(b) by 342 days.

(21) Appl. No.: 13/219,833

(22) Filed: Aug. 29, 2011

(65) Prior Publication Data

US 2013/0049928 A1 Feb. 28, 2013

(51) Int. Cl.

| | |
|---|---|
| ***G08B 19/00*** | (2006.01) |
| ***G07C 11/00*** | (2006.01) |
| *G07B 15/00* | (2011.01) |

(52) U.S. Cl.

CPC ..... *G07C 11/00* (2013.01); *G07B 15/00* (2013.01)

USPC ..... 340/5.51; 340/5.2; 713/168; 713/170; 726/2; 726/4; 726/8; 726/9; 726/12; 726/21

(58) Field of Classification Search

USPC ..... 340/5.51, 5.2; 726/9, 2, 4, 8, 12, 21; 713/168, 170

See application file for complete search history.

(56) References Cited

U.S. PATENT DOCUMENTS

| | | | | |
|---|---|---|---|---|
| 7,494,060 | B2 * | 2/2009 | Zagami | 235/382 |
| 7,607,008 | B2 * | 10/2009 | Howard et al. | 713/155 |
| 7,657,639 | B2 | 2/2010 | Hinton | |
| 2001/0018660 | A1 * | 8/2001 | Sehr | 705/5 |
| 2001/0027527 | A1 * | 10/2001 | Khidekel et al. | 713/201 |
| 2002/0196274 | A1 * | 12/2002 | Comfort et al. | 345/741 |
| 2003/0177388 | A1 * | 9/2003 | Botz et al. | 713/201 |
| 2004/0128541 | A1 * | 7/2004 | Blakley et al. | 713/201 |
| 2004/0153671 | A1 | 8/2004 | Schuyler et al. | |
| 2004/0243464 | A1 * | 12/2004 | Beck | 705/14 |
| 2005/0223217 | A1 * | 10/2005 | Howard et al. | 713/155 |
| 2006/0021011 | A1 * | 1/2006 | Kaplan | 726/5 |
| 2006/0021019 | A1 | 1/2006 | Hinton | |
| 2006/0102717 | A1 * | 5/2006 | Wood et al. | 235/382 |
| 2006/0236382 | A1 * | 10/2006 | Hinton et al. | 726/8 |
| 2007/0186106 | A1 * | 8/2007 | Ting et al. | 713/168 |

(Continued)

OTHER PUBLICATIONS

Quantum Secure, <accessed as of Aug. 23, 2011>, 1 page, copyright 2004-2011, <accessed via the internet: http://www.quantumsecure.com>.

(Continued)

*Primary Examiner* — Benjamin C Lee
*Assistant Examiner* — Quang D Pham
(74) *Attorney, Agent, or Firm* — Parashos T. Kalaitzis; Amy J. Pattillo

(57) ABSTRACT

A host organization system for a host organization of a physical site, receives a request, by a visitor with an identifier of a visitor organization for a visitor access medium, for access to the physical site controlled by a physical access control system requiring presentation of the visitor access medium for access to the physical site, wherein there is an electronic trust relationship between the host organization system and a visitor organization system for the visitor organization via a network, wherein the visitor organization system maintains an electronic identity profile for the visitor. Responsive to the host organization system receiving an authenticated identifier for the visitor from the visitor organization system and validating the authenticated identifier from the visitor organization system, issuing a visitor access medium to the visitor for controlling access to the physical site.

14 Claims, 6 Drawing Sheets

(56) References Cited

U.S. PATENT DOCUMENTS

| | | | | |
|---|---|---|---|---|
| 2008/0046984 | A1* | 2/2008 | Bohmer et al. | 726/5 |
| 2008/0272881 | A1* | 11/2008 | Goel | 340/5.3 |
| 2013/0104245 | A1* | 4/2013 | Nandakumar | 726/28 |

OTHER PUBLICATIONS

Passage Point, <accessed as of Aug. 23, 2011>, 1 page, <accessed via the Internet: http://www.visitormanagement.com.au/>.
Visitor Management on Demand, <accessed as of Aug. 23, 2011>, 3 pages, <accessed via the internet: http://www.visitormanagementsystem.com.au/>.
Bridge Point, <accessed as of Aug. 23, 2011>, 1 page, copyright 2011, <accessed via the internet: http://www.bridgepointsystems.com/>.
CertiPath, <accessed as of Aug. 23, 2011>, 1 page, copyright 2010, <accessed via the interet: http://www.certipath.com/>.
Federated Physical Access Control System (PACS) Specification, 68 pages, <accessed as of Aug. 23, 2011>, <accessed via the internet: http://www.idmanagement.gov/documents/Federated_PACS_Specification.pdf> .
National Institute of Standards and Technology (NIST), Special Publication 800-73-3, Feb. 2010, <accessed as of Aug. 23, 2011> <accessed via the internet: http://csrc.nist.gov/publications/nistpubs/800-73-3/sp800-73-3_PART1_piv-card-applic-namespace-date-model-rep.pdf>.
Homeland Security Presidential Directive 12, <accessed as of Aug. 23, 2011>, last modified on Jul. 1, 2011, 2 pages, <accessed via the Internet: http://www.dhs.gov/xabout/laws/gc_1217616624097.shtm>.
Oasis, Web Services Federation Language (WS-Federation) Version 1.2, Jan. 7, 2009, 121 pages, <accessed via the Internet: http://docs.oasis-open.org/wsfed/federation/v1.2/cd/ws-federation-1.2-spec-cd-02.html>.

* cited by examiner

JUST IN TIME VISITOR AUTHENTICATION AND VISITOR ACCESS MEDIA ISSUANCE FOR A PHYSICAL SITE

BACKGROUND

1. Technical Field

The embodiment of the invention relates generally to data processing systems and particularly to automated just in time visitor authentication and visitor access media issuance for a physical site, where a physical site host and the visitor organization have an existing electronic trust relationship.

2. Description of Related Art

Many businesses have security systems in place that control access to buildings and rooms on a physical site. In one example, a Physical Access Control System (PACS) is a type of security system that, when in place, controls access to buildings and rooms on a physical site. The PACS requires users to present a card and to have proper credentials, before the PACS will open a door or gate.

In addition, for many businesses, it is common to host visitors on the physical site. For visitors to move throughout a physical site with PACS implemented, the visitor may be registered with the PACS system and issued a card. Before a visitor can be issued a card, security personnel may first verify the identity of the visitor.

BRIEF SUMMARY

In view of the foregoing, there is a need for automated just in time PACS visitor access media issuance for visitors at a host physical site, by an existing PACS system. There is a need for automated authentication of the visitor at the host physical site by the visitor organization through visitor entry of credentials registered with the visitor organization, based on an existing electronic trust relationship between the host organization and the visitor organization, and for automated issuance of a visitor access medium based on the authenticated credentials for access to PACS controlled areas.

In one embodiment of the invention, a method of issuing a visitor access medium to a visitor for access to a visitor access medium controlled physical site of a host organization is directed to-receiving, by at least one processor of a host organization system for a host organization of a physical site, a request, by a visitor with an identifier of a visitor organization, for a visitor access medium for access to the physical site controlled by a physical access control system requiring presentation of the visitor access medium for access to the physical site, wherein there is an electronic trust relationship according to a federation standard between the host organization system and a visitor organization system for the visitor organization via a network, wherein the visitor organization system maintains an electronic identity profile for the visitor. The method is directed to-identifying, by the at least one processor, the visitor organization system from among a plurality of visitor organization systems with which the host organization system maintains separate electronic trust relationships according to the federation standard. The method is directed to-outputting, by the at least one processor, a login interface for the visitor to enter identifying information. The method is directed to sending, by the at least one processor, the identifying information input by the visitor through the login interface to the visitor organization system according to the federation standard. The method is directed to receiving, by the at least one processor, an identity provider token dispensed by the visitor organization system according to the federation standard identifying the identity of the visitor is verified by the visitor organization system from the identifying information authenticating in the electronic identity profile for the visitor. The method is directed, responsive to validating the identity provider token is from the visitor organization system, to dispensing, by the at least one processor, a resource token from the host organization system according to the federation standard validating the identity of the visitor by the visitor organization system. The method is directed to translating, by the at least one processor, data in the resource token specified according to the federation standard into a physical access control system request for the visitor access medium formatted for calling a physical access control system application programming interface. The method is directed to sending, by a visitor access service of the host organization system, the physical access control system request to a visitor provision service interface layer atop a physical access control system to call the physical access control system application program interface, for adding the visitor to the physical access control system and triggering issuance of the visitor access medium for the visitor, wherein the visitor provision service layer provides an interface between the host organization system and the physical access control system, wherein the visitor provision service layer distributes the physical access control system request to at least one physical access control system provider comprising the physical access control system application program interface of the physical access control system, wherein each physical access control system provider provisions access by the visitor using the physical visitor access medium by each of a plurality of door controllers.

In another embodiment, a system for issuing a visitor access medium to a visitor for access to a visitor access medium controlled physical site of a host organization comprises one or more processors. The system comprises a host organization system, for execution by at least one of said one or more processors, operative to receive, for a host organization of a physical site, a request, by a visitor with an identifier of a visitor organization, for a visitor access medium for access to the physical site controlled by a physical access control system requiring presentation of the visitor access medium for access to the physical site, wherein there is an electronic trust relationship according to a federation standard between the host organization system and a visitor organization system for the visitor organization via a network, wherein the visitor organization system maintains an electronic identity profile for the visitor. The system comprises the host organization system operative to identify the visitor organization system from among a plurality of visitor organization systems with which the host organization system maintains separate electronic trust relationships according to the federation standard. The system comprises the host organization system operative to output a login interface for the visitor to enter identifying information. The system comprises the host organization system operative to send the identifying information input by the visitor through the login interface to the visitor organization system according to the federation standard. The system comprises the host organization system operative to receive an identity provider token dispensed by the visitor organization system according to the federation standard identifying the identity of the visitor is verified by the visitor organization system from the identifying information authenticating in the electronic identity profile for the visitor. The system comprises the host organization system, responsive to validating the identity provider token is from the visitor organization system, operative to dispense a resource token from the host organization system according to the federation standard validating the identity of the visitor by the visitor organization system. The system comprises the host organization system, operative to translate data in the resource token specified according to the federation standard into a physical access control system request for the visitor access medium formatted for calling a physical access control system application programming interface. The system comprises the host organization system, operative to send, by a visitor access service of the host organization system, the physical access control system request to a visitor provision service interface layer atop a physical access control system to call the physical access control system application program interface, for adding the visitor to the physical access control system and triggering issuance of the visitor access medium for the visitor, wherein the visitor provision service layer provides an interface between the host organization system and the physical access control system, wherein the visitor provision service layer distributes the physical access control system request to at least one physical access control system provider comprising the physical access control system application program interface of the physical access control system, wherein each physical access control system provider provisions access by the visitor using the physical visitor access medium by each of a plurality of door controllers.

In another embodiment, a computer program product for issuing a visitor access medium to a visitor for access to a visitor access medium controlled physical site of a host organization comprises one or more computer-readable, tangible storage devices. The computer program product comprises program instructions, stored on at least one of the one or more storage devices to receive, for a host organization system of a host organization of a physical site, a request, by a visitor with an identifier of a visitor organization, for a visitor access medium for access to the physical site controlled by a physical access control system requiring presentation of the visitor access medium for access to the physical site, wherein there is an electronic trust relationship according to a federation standard between the host organization system and a visitor organization system for the visitor organization via a network, wherein the visitor organization system maintains an electronic identity profile for the visitor. The computer program product comprises program instructions, stored on at least one of the one or more storage devices to identify the visitor organization system from among a plurality of visitor organization systems with which the host organization system maintains separate electronic trust relationships according to the federation standard. The computer program product comprises program instructions, stored on at least one of the one or more storage devices to output a login interface for the visitor to enter identifying information. The computer program product comprises program instructions, stored on at least one of the one or more storage devices to send the identifying information input by the visitor through the login interface to the visitor or organization system according to the federation standard. The computer program product comprises program instructions, stored on at least one of the one or more storage devices to receive an identity provider token dispensed by the visitor organization system according to the federation standard identifying the identity of the visitor is verified by the visitor organization system from the identifying information authenticating in the electronic identity profile for the visitor. The computer program product comprises program instructions, stored on at least one of the one or more storage devices, responsive to validating the identity provider token is from the visitor organization system, to dispense a resource token from the host organization system according to the federation standard validating the identity of the visitor by the visitor organization system. The computer program product comprises program instructions, stored on at least one of the one or more storage devices to translate data in the resource token specified according to the federation standard into a physical access control system request for the visitor access medium formatted for calling a physical access control system application programming interface. The computer program product comprises program instructions, stored on at least one of the one or more storage devices to send the physical access control system request to a visitor provision service interface layer atop a physical access control system to call the physical access control system application program interface, for adding the visitor to the physical access control system and triggering issuance of the visitor access medium for the visitor, wherein the visitor provision service layer provides an interface between the host organization system and the physical access control system, wherein the visitor provision service layer distributes the physical access control system request to at least one physical access control system provider comprising the physical access control system application program interface of the physical access control system, wherein each physical access control system provider provisions access by the visitor using the physical visitor access medium by each of a plurality of door controllers.

BRIEF DESCRIPTION OF THE SEVERAL VIEWS OF THE DRAWINGS

The novel features believed characteristic of one or more embodiments of the invention are set forth in the appended claims. The one or more embodiments of the invention itself however, will best be understood by reference to the following detailed description of an illustrative embodiment when read in conjunction with the accompanying drawings, wherein:

DETAILED DESCRIPTION

In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

In addition, in the following description, for purposes of explanation, numerous systems are described. It is important to note, and it will be apparent to one skilled in the art, that the present invention may execute in a variety of systems, including a variety of computer systems and electronic devices operating any number of different types of operating systems.

Figure 1:
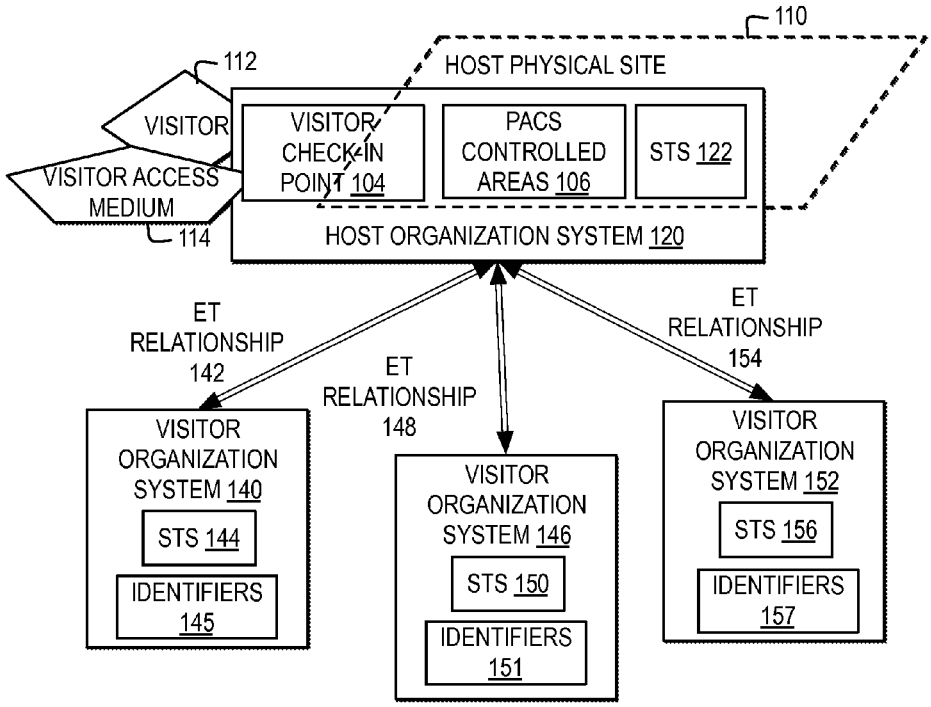
FIG. 1 illustrates a block diagram of one example of a host physical site with PACS controlled areas providing automated just in time visitor authentication at the host site and issuance of visitor access media for access to the PACS controlled areas of the host physical site.

FIG. 1 illustrates a block diagram of one example of a host physical site with PACS controlled areas providing automated just in time visitor authentication at the host site and issuance of visitor access media for access to the PACS controlled areas of the host physical site.

In the example, a host organization represents one or more entities or users. In the example, a host organization is electronically represented by a host organization system 120. In addition, the host organization manages one or more physical sites, such as a host physical site 110. Host organization system 120 may represent one or more systems distributed geographically in multiple locations and may be shared by one or more host entities. In addition, host physical site 110 may represent one or more physical areas managed by one or more host entities.

The host organization may provide one or more visitors, such as visitor 112, with access to one or more areas within host physical site 110. Visitors to host physical site 110 may be associated with one or more entities, referred to as visitor organizations. In the example, each visitor organization is electronically represented by a visitor organization system, including, but not limited to, visitor organization system 140, visitor organization system 146, and visitor organization system 152. A visitor organization may represent a business partners, customer, service provider, or other type of partner of the host of host physical site 110.

In the example, the host organization of host physical site 110 may require that all visitors use a visitor access medium to access areas of host physical site 110, such as visitor access medium 114, readable within host physical site 110 by one or more physical access control systems (PACS) defining PACS controlled areas 106. In particular, host physical site 110 includes PACS controlled areas 106, which represent one or more areas within host physical site 110 to which ingress or egress by any visitor, such as visitor 112, requires presentation of a visitor access medium 114 and requires the visitor have the required credentials for the controlled area. A host organization system 120 may include one or more PACS systems to manage PACS controlled areas 106. In one example, visitor access media include PACS provisioned visitor cards and other temporary access badges. In another example, visitor access media as described herein may include one or more types of physical, portable media specified and provisioned at visitor check-in point 104 and readable by door controllers within PACS controlled areas 106 to control access to PACS controlled areas 106 including, but not limited to, paper cards, bar code cards, magnetic cards, physical access tokens, media embedded with an electronic microchip, and media embedded with radio frequency identifier (RFID) chips. Visitor access media include portable media of multiple sizes and shapes that, for example, may be carried by the user or affixed to the user, such as by being clipped to a lanyard or worn as a pendant. In one example, visitor access media are specified and provisioned by the host organization for use by visitors using a physical, portable storage medium provided by the host organization. The host organization system may issue visitor access media that are distinguishable from employee cards issued to regular employees of the host organization. In another example, a visitor may also present a physical, portable storage medium at visitor check-in point 104 and the visitor's physical, portable storage medium may be specified and temporarily provisioned for use as a visitor access medium.

Prior to a host organization issuing visitor access medium 114 to visitor 112, when visitor 112 arrives on site, the host organization verifies the identity of visitor 112 at one of one or more visitor check-in points, such as visitor check-in point 104. Visitor check-in point 104 provides automated visitor identity authentication when visitor 112 arrives at host physical site 110. Once visitor check-in point 104 authenticates the identity of visitor 112, visitor check-in point 104 provides automated just in time issuance of visitor access medium 114. In one example, visitor check-in point 104 provides automated just in time issuance of visitor access medium 114 by provisioning visitor access medium 114 through a PACS visitor access provisioning system by sending a PACS request based on the authenticated visitor identity.

In the example, when a visitor requests to enter host physical site 110 at visitor check-in point 104, the visitor does not have an electronic identity managed by the host organization, however, host organization system 120 is able to automate the authentication of a visitor identity if the visitor is from a visitor organization with an existing electronic trust relationship with host organization system 120. In the example, an electronic trust (ET) relationship 142 is established between host organization system 120 and visitor organization system 140, an ET relationship 148 is established between host organization system 120 and visitor organization system 146, and an ET relationship 154 is established between host organization system 120 and visitor organization system 152. While host organization system 120 may have an existing electronic trust relationship established with each of visitor organization systems 140, 146, and 152, each of visitor organization systems 140, 146, and 152 may or may not have an existing electronic trust relationship established between one another.

In particular, in one example, visitor 112 to host physical site 110 does not have an electronic identity managed by host organization system 120, however, visitor 112 does have an electronic identity managed in identifiers 145 by visitor organization system 140. In the example, visitor organization system 140 maintains identifiers 145, visitor organizations system 146 maintains identifiers 151, and visitor organization system 152 maintains identifiers 157, where each of identifiers 145, 151, and 157 include one or more electronic identity accounts for one or more users. Each electronic identity account stores authentication information sufficient to authenticate a purported identity of a user, when the user providers the required credentials or other identifying information for authenticating the user's identification.

In the example, host organization system 120 automates the authentication of a visitor identity by requesting that a visitor organization system associated with the visitor at visitor check-in point 104 authenticate the identity of the visitor. The visitor organization system receives a user's credentials entered at visitor check-in point 104 and if the visitor organization authenticates the user's credentials against the user's electronic identity account, sends an authentication response, in the form of a secure token, to host organization system 120. Host organization system 120 validates the authentication response based on the electronic trust relationship between host organization system 120 and the visitor organization authentication service. The electronic trust relationships, such as ET relationships 142, 148, and 154, between host organization system 120 and a visitor organization are implemented so that host organization 120, which does not maintain authentication information for visitors, may rely on visitor organizations, which do maintain electronic identity accounts containing authentication information for users, to authenticate the identity of the visiting user, to host organization system 120.

In one example, ET relationships 142, 148, and 154 are implemented through electronic trust relationships in accordance with the WS-Federation standard established between host organization system 120 and each visitor organization system. In particular, host organization system 120 implements the authentication process established by existing electronic trust relationships in accordance with the WS-Federation standard for authenticating visitors for access to host electronic services, to also authenticate visitors for authenticating visitor identifies and issuing just in time visitor access media to visitors for access to host physical site 110. Each of host organization 120 and visitor organization systems 140, 146, and 152 runs and manages a Secure Token Issuing Service (STS) in accordance with the WS-Federation standard, such as STS 122, 144, 150, and 156. The WS-Federation standard implements additional standards including, but not limited to, WS-Trust and WS-Security standards.

As illustrated in FIG. 1, by combining the system architecture for an existing electronic trust relationship with an existing PACS to provide automated just in time issuance of PACS based visitor access media for visitors from visitor organizations with an existing relationship with the host organization at visitor check-in point 104, a host organization can use existing PACS and existing visitor access medium generation systems to automate issuance of just in time visitor access media using visitor organization authentication. In addition, by automating visitor identity authentication and providing automated just in time issuance of visitor access media for visitors from visitor organizations with an existing electronic trust relationship with the host organization at visitor check-in point 104, the host organization uses existing electronic trust relationships established for authenticating visitors for electronic access to host organization system 120 to reduce the time, cost, and potential human error associated with authenticating visitor identities and issuing just in time visitor access media for physical site access. Using the existing electronic trust relationship between a host organization and visitor organization for automating visitor identity authentication for physical site access also increases the efficiency of authenticating visitors using the relationship already established. Moreover, using the existing electronic trust relationship between a host organization and visitor organization for automating visitor identity authentication for physical site access also allows for both organizations to efficiently track visitor requests and movement.

In another example, when a visitor arrives at host physical site 110 from a visitor organization that does not have an existing electronic trust relationship with the host organization, visitor identity authentication and issuance of visitor access medium 114 may require one or more manual steps performed by security personnel for the host organization and the visitor in addition to or separate from visitor check-in point 104. For example, a visitor from a visitor organization that does not have an existing electronic trust relationship with the host organization may be required to fill out paperwork or an online form providing information about the visitor and reason for the visitor and to present a form of identification such as a passport. Security personnel from host organization, when the identity of the visitor is confirmed, may initiate the issuance of a visitor access medium to the visitor. In addition, the host organization may also require that visitors from visitor organizations that do not have an existing electronic trust relationship with the host organization register with the host organization prior to arriving onsite through manual or automated approval interfaces approved by the host organization.

Figure 2:
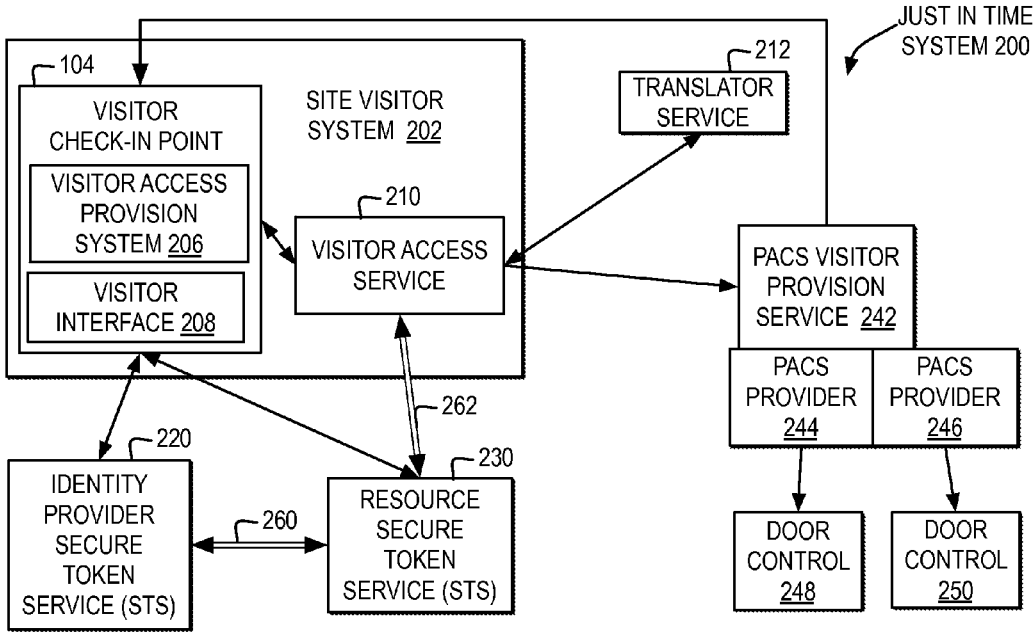
FIG. 2 illustrates a block diagram of one example of implementing visitor authentication and just in time issuance of visitor access media for access to PACS controlled areas of a host physical site.

With reference now to FIG. 2, a block diagram illustrates one example of implementing visitor authentication and just in time issuance of visitor access media for access to PACS controlled areas of a host physical site.

In the example, a just in time system 200 for a particular host organization includes a site visitor system 202, which includes at least one visitor check-in point, such as visitor check-in point 104. Visitor check-in point 104 includes a visitor access service 210 providing a graphical user interface (GUI) for allowing a visitor to log on through visitor interface 208 at visitor check-in point 104. In one example, a visitor interacts with visitor interface 208 to start or invoke the GUI of visitor access service 210. In one example visitor interface 208 is a web browser. The GUI of visitor access service 210 allows a visitor to logon to visitor access service 210, including selecting the visitor's employer from among a list of visitor organizations, and to request a PACS visitor access medium issuance.

Visitor access service 210 manages the automated trusted authentication and identity verification of the visitor for a host organization, where the visitor is from a visitor organization with an existing electronic trust relationship with the host organization enabling authentication under the WS-Federation standard. In addition, visitor check-in point 104 includes a visitor access provision system 206 for specifying and provisioning visitor access media on one or more types of portable, physical media, immediately following a successful authentication of a visitor identity using the visitor's organization's authentication credentials, based on the existing electronic trust relationship between the host organization and the visitor organization.

In the example, an existing electronic trust relationship is established between the host organization and a particular visitor organization according to the WS-Federation standard, including resource secure token service (STS) 230 run and managed by host organization system 120 and identity provider secure token service (STS) 220 run and managed by the visitor organization system for the visitor organization selected by the current visitor. In particular, in the example, the electronic trust relationship established between the host organization and a particular visitor organization is further extended by trust relationships established according to the WS-Federation standard between identity provider STS 220 and resource STS 230 as illustrated at reference numeral 260 and between visitor access service 210 and resource STS 230 as illustrated at reference numeral 262. Identity provider STS 220 manages an electronic identity account for a visitor and manages the authentication of the identity of the visitor for the host organization. Resource STS 230 authenticates that an authenticated identity token issued by identity provider STS 220 is issued by the visitor organization.

In addition, in the example, just in time system 200 includes a translator service 212. Translator 212 is accessed by visitor access service 210, either as a component of visitor access service 210 or as a separate service accessible via a network. Visitor access service 210 receives a WS-Federation secure token authenticating the visitor identity directed from visitor interface 208 and translator 212 translates the WS-Federation secure token and additional data from visitor interface 208 into a PACS visitor access provisioning request for sending to PACS visitor provision service 242.

In the example, PACS visitor provision service 242 provides an interface to visitor access service 210 for submitting PACS visitor access provisioning requests. For example, PACS visitor provision service 242 provides a service layer interface above PACS provider application programming interfaces (APIs) and other interfaces, illustrated as PACS provider 244 and PACS provider 246. Each of PACS provider 244 and PACS provider 246 direct one or more door controllers, such as door control 248 and door control 250, which control access to PACS controller areas 106. In one example, PACS provider 244 and PACS provider 246 are existing PACS provider systems for controlling PACS controlled areas 106 within host physical site 110 and PACS visitor provision service 242 is added to extend the existing PACS system In the example, door control 248 and door control 250 may include readers for detecting one or more types of visitor access media. Door control 248 and door control 250 may detect visitor access media placed in contact with a reader or may detect visitor access media physically present within a local area.

Figure 3:
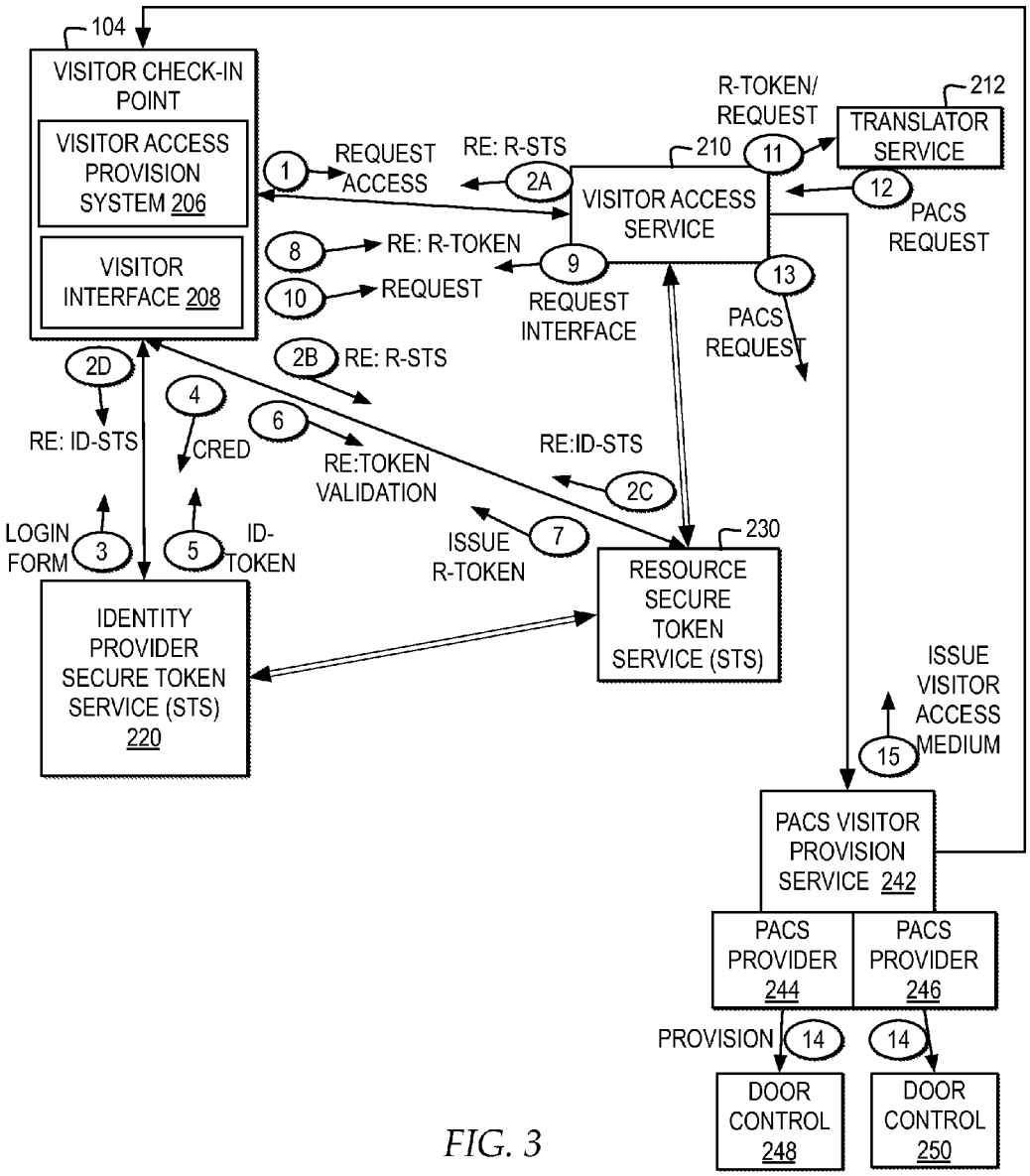
FIG. 3 illustrates a block diagram illustrates one example of a flow of communications between components in a system implementing just in time visitor authentication and issuance of visitor access media for access to PACS controlled areas of a host physical site.

With reference now to FIG. 3, a block diagram illustrates one example of a flow of communications between components in a system implementing just in time visitor authentication and issuance of visitor access media for access to PACS controlled areas of a host physical site.

Figure 4:
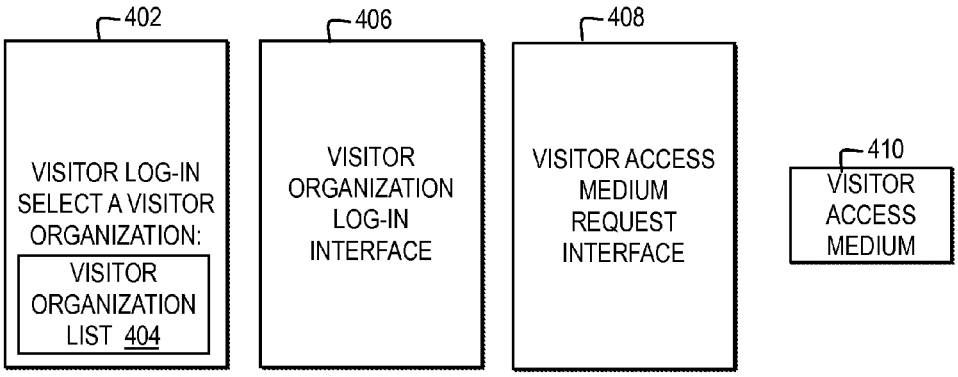
FIG. 4 illustrates one example of the graphical user interface output to a visitor and the visitor access medium issued to the visitor at a visitor check-in point for a host physical site, when the visitor is from a visitor organization with an electronic trust relationship with the host organization.

In the example, a visitor starts or invokes the GUI of visitor access service 210 through visitor interface 208, such as through a browser window. The GUI at visitor interface 208 allows the visitor to select the visitor's organization. For example, as illustrated in FIG. 4, visitor interface 208 may include a window 402 that includes a selectable visitor organization list 404 from which a visitor selects a visitor organization associated with the visitor. In the example, visitor organization list 404 may include a list of the visitor organizations with which the host organization has an existing electronic trust relationship.

As illustrated, the visitor requests (1) access under the selected visitor organization. Visitor access service 210 sends a redirect message (2A) to visitor interface 208 to send the request to resource secure token service (STS) 230, provided by the host organization. Visitor interface 208 sends a redirect message (2B) to resource STS 230. Resource STS 230 receives the redirected message (2B) with the access request and the selected visitor's organization, identifies the identity provider STS registered with the host for the visitor organization, and returns a message (2C) designating the identified identity provider STS. In the example, the registered, trusted identity provider STS for the requested visitor organization is identity provider STS 220. Visitor interface 208 sends a redirect message (2D) with the access request to identity provider STS 220.

Identity provider STS 220 presents the user with the visitor organization's login form (3) within visitor interface 208. For example, as illustrated in FIG. 4, visitor interface 208 may include a window 406 that includes the visitor organization log-in interface. The credentials or other identifying information (4) entered by the visitor in the visitor organization's login interface within visitor interface 208 are received by identity provider STS 220. Identity provider STS 220 authenticates the visitor using the visitor's employer authentication credentials entered by the visitor and creates a Security Assertion Markup Language (SAML) ID-token containing the authenticated identity of the visitor and attribute assertions, where the token is signed and encrypted in accordance with the WS-Federation standard. In one example, the attribute assertions in the SAML ID-token may include, but are not limited to, basic name and contact details, contract identifiers and validity dates, professional and technical qualifications, and photograph. While in the example, the token verifying a visitor identity is referred to as a SAML ID-token, in other examples, the visitor verification token may include additional or alternate types of tokens or authentication elements.

Identity provider STS 220 sends the ID-token (5) generated by the identity provider for the visitor organization back to visitor interface 208. Visitor interface 208 redirects the ID-token (6) to resource STS 230 for the host organization. Resource STS 230 validates the token from identity provider STS 220 and issues a new SAML R-token (7) for use by visitor access service 210. The assertions contained in the ID-token received by resource STS 230 are copied into the new R-token issued by resource STS 230. While in the example, the token validating that the visitor verification token is issued by the visitor organization system is referred to as an SAML R-token or resource token, in other examples, the validation token may include additional or alternate types of tokens or authentication elements.

Visitor interface 208 receives the R-token issued by resource STS 230 and redirects the R-token (8) to visitor access service 210. Visitor access service 210 verifies the R-token is issued by resource STS 230 and enables the visitor access medium interface GUI (9) at visitor interface 208 through which the visitor is permitted to request a PACS visitor access medium. For example, as illustrated in FIG. 4, visitor interface 208 may include a window 408 that includes the visitor access medium request interface. Within the visitor access medium request interface window 408, the visitor may be prompted to provide information not included in the attribute assertions including, but not limited to, a contract period or other information related to a visitation period. Visitor interface 208 sends the PACS visitor access medium request (10) with any additional information entered by the visitor to visitor access service 210.

A message (11) with the R-token issued by resource STS 230 and any additional data collected by visitor access service 210 are sent to translator service 212. Translator service 212 reads the R-token and additional data, translates the token and additional data into a PACS visitor service request, and returns a formatted PACS visitor service request (12) to visitor access service 210. Visitor access service 210 sends a message (13) with the PACS visitor service request to a PACS visitor provision service 242. PACS visitor provision service 242 provides an interface for distributing the PACS visitor service request to PACS providers 244 and 246. PACS providers 244 and 246 send messages (14) to update door controls 248 and 250 with information about the new visitor access medium to be issued. PACS visitor provision service 242 also sends instructions (15) to issue the new visitor access medium to visitor access provision system 206 to be generated at visitor check-in point 104 for the visitor to use. For example, as illustrated in FIG. 4, visitor access provision system 206 may generate a visitor access medium 410 specified for the particular visitor, at visitor check-in point 104.

Figure 5:
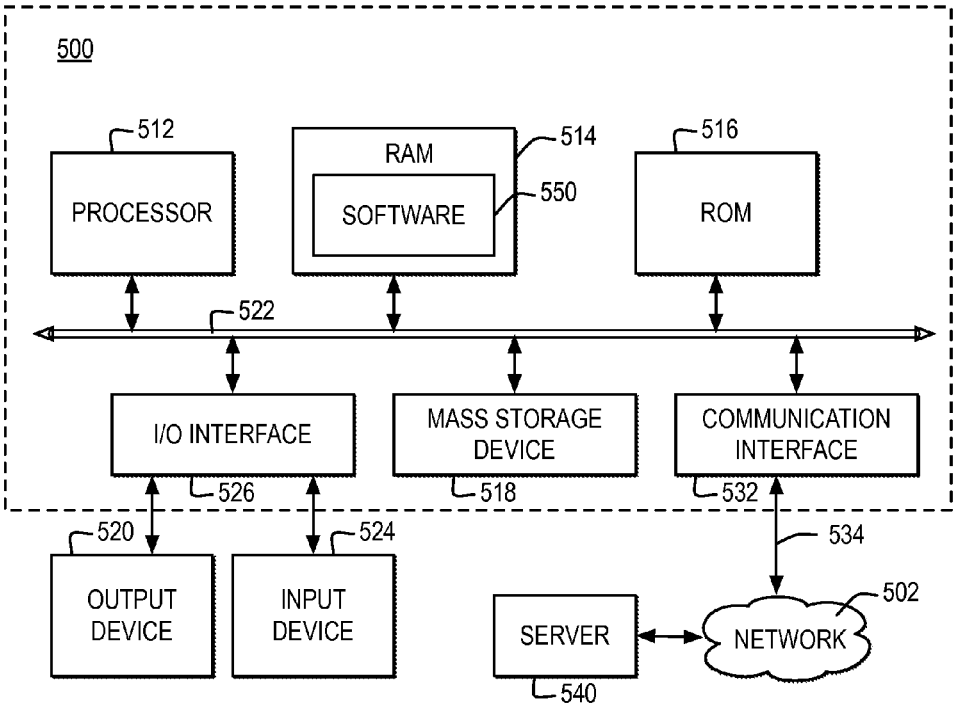
FIG. 5 illustrates one example of a computer system in which one embodiment of the invention may be implemented.

FIG. 5 illustrates one example of a computer system in which one embodiment of the invention may be implemented. The present invention may be performed in a variety of systems and combinations of systems, made up of functional components, such as the functional components described with reference to computer system 500 and may be communicatively connected to a network, such as network 502.

Computer system 500 includes a bus 522 or other communication device for communicating information within computer system 500, and at least one hardware processing device, such as processor 512, coupled to bus 522 for processing information. Bus 522 preferably includes low-latency and higher latency paths that are connected by bridges and adapters and controlled within computer system 500 by multiple bus controllers. When implemented as a server or node, computer system 500 may include multiple processors designed to improve network servicing power. Where multiple processors share bus 522, additional controllers (not depicted) for managing bus access and locks may be implemented.

Processor 512 may be at least one general-purpose processor such as IBM® PowerPC® (IBM and PowerPC are registered trademarks of International Business Machines Corporation) processor that, during normal operation, processes data under the control of software 550, which may include at least one of application software, an operating system, middleware, and other code and computer executable programs accessible from a dynamic storage device such as random access memory (RAM) 514, a static storage device such as Read Only Memory (ROM) 516, a data storage device, such as mass storage device 518, or other data storage medium. Software 550 may include, but is not limited to, code, applications, protocols, interfaces, and processes for controlling one or more systems within a network including, but not limited to, an adapter, a switch, a cluster system, and a grid environment.

In one embodiment, the operations performed by processor 512 may control the operations of flowchart of FIGS. 6-11 and other operations described herein. Operations performed by processor 512 may be requested by software 550 or other code or the steps of one embodiment of the invention might be performed by specific hardware components that contain hardwired logic for performing the steps, or by any combination of programmed computer components and custom hardware components.

Those of ordinary skill in the art will appreciate that aspects of one embodiment of the invention may be embodied as a system, method or computer program product. Accordingly, aspects of one embodiment of the invention may take the form of an entirely hardware embodiment, an entirely software embodiment (including firmware, resident software, microcode, etc.) or an embodiment containing software and hardware aspects that may all generally be referred to herein as "circuit," "module," or "system." Furthermore, aspects of one embodiment of the invention may take the form of a computer program product embodied in one or more tangible computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, device, or any suitable combination of the foregoing. More specific examples (a non-exhaustive list) of the computer readable storage medium would include the following: an electrical connection having one or more wires, a portable computer diskette, a hard disk, such as mass storage device 518, a random access memory (RAM), such as RAM 514, a read-only memory (ROM) 516, an erasable programmable read-only memory (EPROM or Flash memory), an optical fiber, a portable compact disc read-only memory (CDROM), an optical storage device, a magnetic storage device, or any suitable combination of the foregoing. In the context of this document, a computer readable storage medium may be any tangible medium that can contain or store a program for use by or in connection with an instruction executing system, apparatus, or device.

A computer readable signal medium may include a propagated data signal with the computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction executable system, apparatus, or device.

Program code embodied on a computer readable medium may be transmitted using any appropriate medium, including but not limited to, wireless, wireline, optical fiber cable, radio frequency (RF), etc., or any suitable combination of the foregoing.

Computer program code for carrying out operations of on embodiment of the invention may be written in any combination of one or more programming languages, including an object oriented programming language such as Java™, Smalltalk, C++ or the like and conventional procedural programming languages, such as the "C" programming language or similar programming languages. The program code may execute entirely on the user's computer, such as computer system 500, partly on the user's computer, as a stand-alone software package, partly on the user's computer and partly on a remote computer or entirely on the remote computer or server. In the latter scenario, the remote computer may be connected to the user's computer through any type of network, such as network 502, through a communication interface, such as network interface 532, over a network link that may be connected, for example, to network 502.

In the example, network interface 532 includes an adapter 534 for connecting computer system 500 to interconnection network 536 through a link. Although not depicted, network interface 532 may include additional software, such as device drivers, additional hardware and other controllers that enable communication. When implemented as a server, computer system 500 may include multiple communication interfaces accessible via multiple peripheral component interconnect (PCI) bus bridges connected to an input/output controller, for example. In this manner, computer system 500 allows connections to multiple clients via multiple separate ports and each port may also support multiple connections to multiple clients.

One embodiment of the invention is described below with reference to flowchart illustrations and/or block diagrams of methods, apparatus (systems) and computer program products according to embodiments of the invention. Those of ordinary skill in the art will appreciate that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable medium that can direct a computer, such as computer system 500, or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer, such as computer system 500, or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

Network interface 532, the network link to network 502, and network 502 may use electrical, electromagnetic, or optical signals that carry digital data streams. The signals through the various networks and the signals on network 502, the network link to network 502, and network interface 532 which carry the digital data to and from computer system 500, may be forms of carrier waves transporting the information.

In addition, computer system 500 may include multiple peripheral components that facilitate input and output. These peripheral components are connected to multiple controllers, adapters, and expansion slots, such as input/output (I/O) interface 526, coupled to one of the multiple levels of bus 522. For example, input device 524 may include, for example, a microphone, a video capture device, an image scanning system, a keyboard, a mouse, or other input peripheral device, communicatively enabled on bus 522 via I/O interface 526 controlling inputs. In addition, for example, output device 520 communicatively enabled on bus 522 via I/O interface 526 for controlling outputs may include, for example, one or more graphical display devices, audio speakers, and tactile detectable output interfaces, but may also include other output interfaces. In alternate embodiments of the present invention, additional or alternate input and output peripheral components may be added.

Those of ordinary skill in the art will appreciate that the hardware depicted in FIG. 5 may vary. Furthermore, those of ordinary skill in the art will appreciate that the depicted example is not meant to imply architectural limitations with respect to the present invention.

Figure 6:
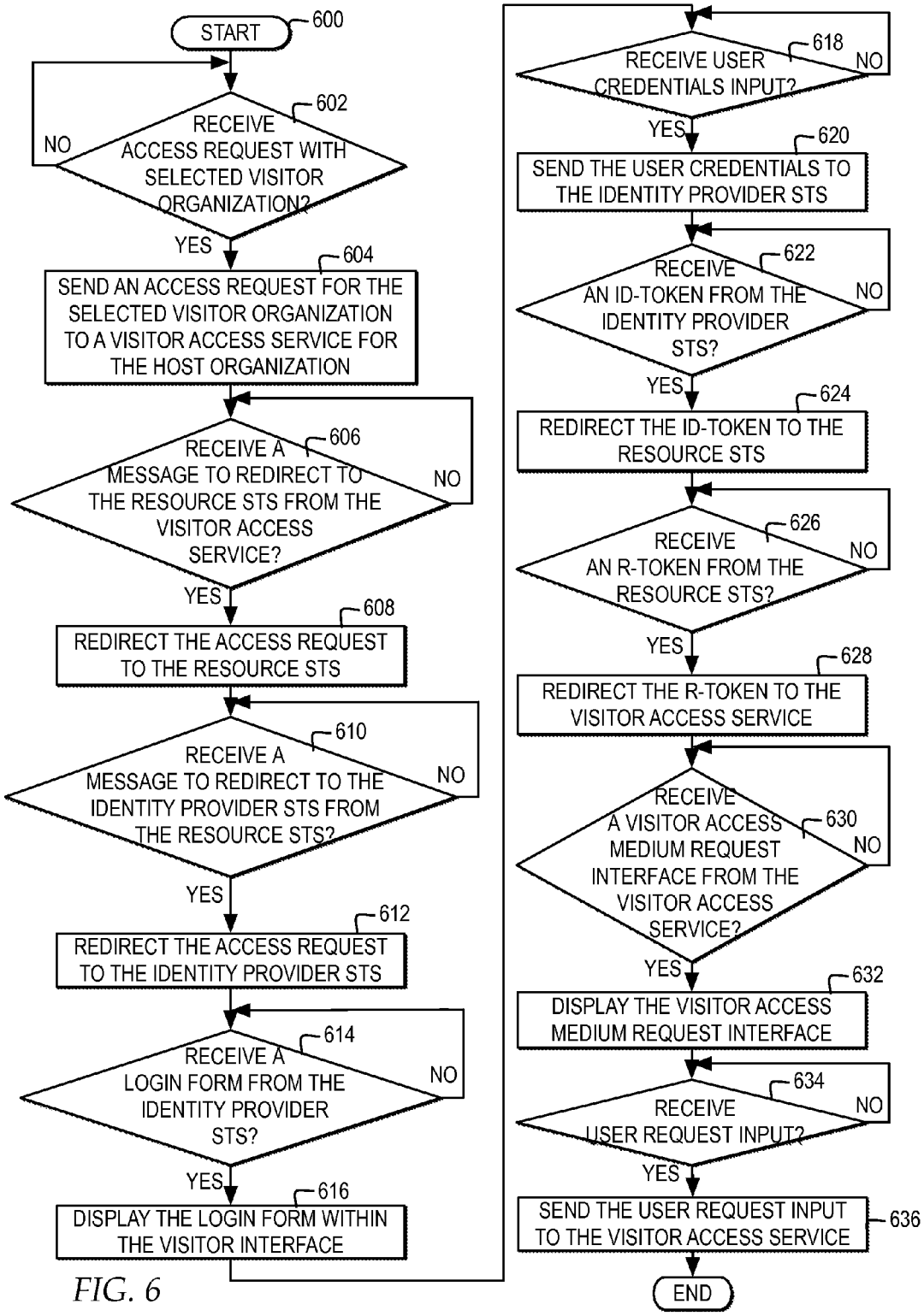
FIG. 6 illustrates a high level logic flowchart of a process and program for managing visitor authentication at a visitor interface at a visitor check-in point when a visitor arrives at a host physical site.

FIG. 6 illustrates a high level logic flowchart depicting a process and program for managing visitor authentication at a visitor interface at a visitor check-in point when a visitor arrives at a host physical site. As illustrated, the process starts at block 600 and thereafter proceeds to block 602. Block 602 illustrates a determination whether an access request is received at a visitor interface with a selected visitor organization in the access request. If an access request is received at a visitor organization with a selected visitor organization in the access request, then the process passes to block 604. If an access request is not yet received, the process waits at block 602.

Block 604 illustrates sending an access request for the selected visitor organization to a visitor access service for the host organization. Next, block 606 depicts a determination whether the visitor interface receives a request from the visitor access service to redirect the access request to a resource STS for the host organization. If the visitor interface receives a redirect request, then the process passes to block 608.

Block 608 illustrates redirecting the access request to the resource STS. Next, block 610 depicts a determination whether the visitor interface receives a request from the resource STS to redirect the access request to an identity provider STS. If the visitor interface receives a redirect request, then the process passes to block 612.

Block 612 illustrates redirecting the access request to the identity provider STS. Next, block 614 depicts a determination whether a login form is received from the identity provider STS. If a login form is received from the identity provider STS, then the process passes to block 616.

Block 616 illustrates displaying the login form within the visitor interface. Next, block 618 depicts a determination whether the visitor interface receives an input of user credentials through at least one of the input interfaces of the visitor interface. If the visitor interface receives user credentials, then the process passes to block 620.

Block 620 depicts sending the user credentials to the identity provider STS. Next, block 622 illustrates a determination whether the visitor interface receives an ID-token from the identity provider STS. If an ID-token is received from the identity provider STS, then the process passes to block 624.

Block 624 depicts redirecting the ID-token to the resource STS. Next, block 626 illustrates a determination whether the visitor interface receives an R-token from the resource STS. If an R-token is received from the resource STS, then the process passes to block 628.

Block 628 depicts redirecting the R-token to the visitor access service. Next, block 630 illustrates a determination whether a visitor access medium request interface is received from the visitor access service. If a visitor access medium request interface is received from the visitor access service, then the process passes to block 632. Block 632 illustrates displaying the visitor access medium request interface. Next, block 634 depicts a determination whether the visitor interface receives user request input in the visitor access medium request interface. If the visitor interface receives user request input, then the process passes to block 636. Block 636 illustrates sending the user request input to the visitor access service, and the process ends.

Although not depicted, at blocks 606, 610, 614, 618, 622, 626, 630, or 634, if the visitor interface does not receive a particular message or input after a timeout period or the visitor interface receives an error message or other message, then the process may control output of an error message and end or return to block 602.

Figure 7:
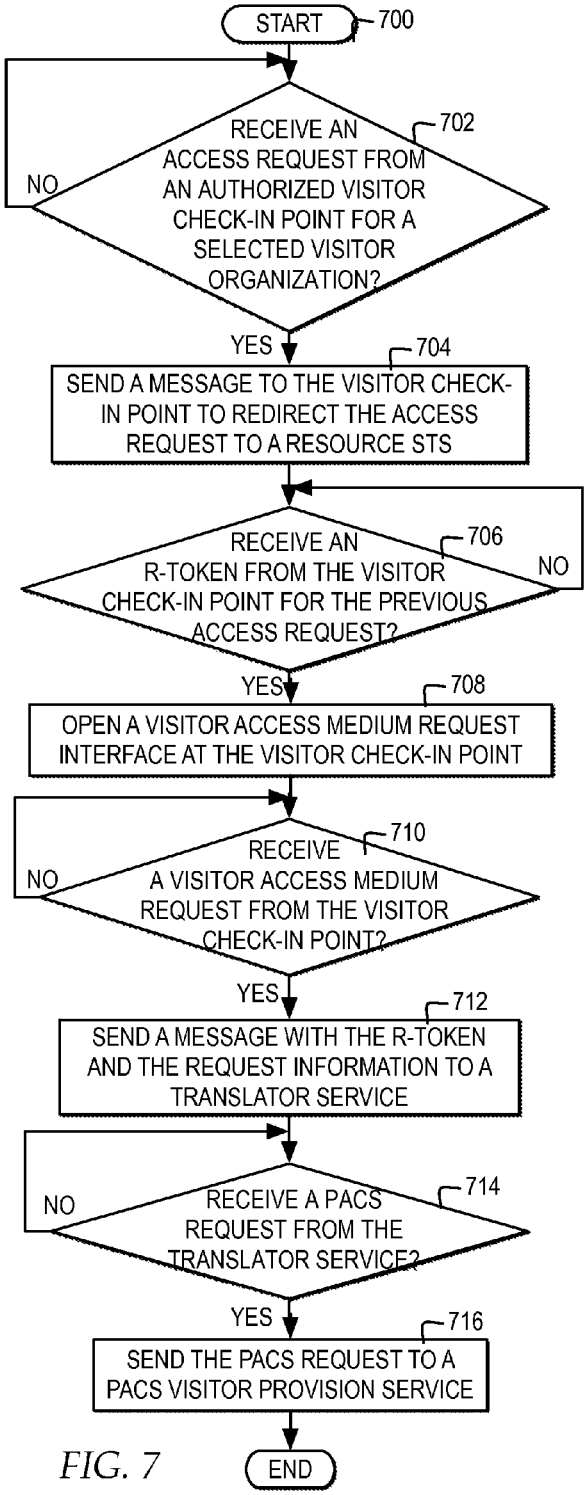
FIG. 7 illustrates a high level logic flowchart of a process and program for managing just in time visitor authentication at a visitor check-in point based on an existing electronic relationship between the visitor organization and the host organization and managing updates to a PACS system and just in time issuance of a PACS visitor access medium when a visitor arrives at a host physical site.

FIG. 7 illustrates a high level logic flowchart depicting a process and program for managing just in time visitor authentication at a visitor check-in point based on an existing electronic relationship between the visitor organization and the host organization and managing updates to a PACS system and just in time issuance of a PACS visitor access medium when a visitor arrives at a host physical site. As illustrated, the process starts at block 700 and thereafter proceeds to block 702. Block 702 illustrates a determination whether the visitor access service receives an access request from an authorized visitor check-in point for a selected visitor organization. If the visitor access service receives an access request from an authorized visitor check-in point for a selected visitor organization, then the process passes to block 704.

Block 704 illustrates sending a message to the visitor check-in point to redirect the access request to a resource STS, where the visitor access service and the resource STS have a electronic trust relationship. Next, block 706 depicts a determination whether the visitor access service receives an R-token from the visitor check-in point. If the visitor access service receives an R-token from the visitor check-in point, then the process passes to block 708.

Block 708 illustrates opening a visitor access medium request interface at the visitor check-in point. Next, block 710 depicts a determination whether the visitor access service receives a visitor access medium request from user input to the visitor access medium request interface at the visitor check-in point. If the visitor access service receives a valid visitor access medium request, then the process passes to block 712.

Block 712 illustrates sending a message with the R-token and the request information to a translator service. Next, block 714 depicts a determination whether the visitor access service receives a PACS request from the translator service. If the visitor access service receives a PACS request from the translator service, then the process passes to block 716. Block 716 illustrates sending the PACS request to a PACS visitor provision service, and the process ends.

Although not depicted, at block 706, 710, and 714, if the visitor access service does not receive a particular message or input after a timeout period or the visitor interface receives an error message or other message, then the process may control output of an error message and end or return to block 702.

Figure 8:
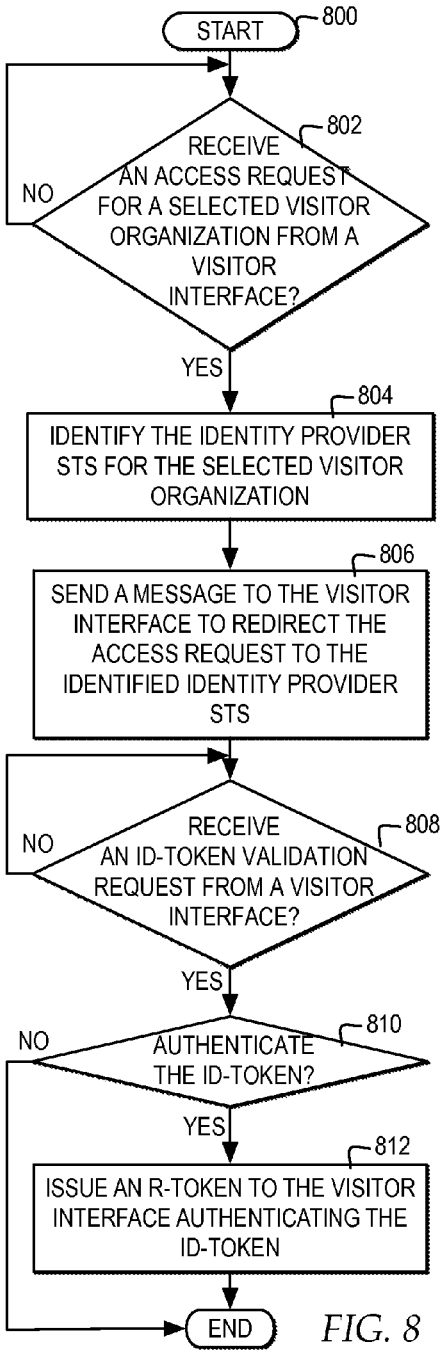
FIG. 8 illustrates a high level logic flowchart of a process and program for managing identity provider authentication by a resource STS with an electronic trust relationship with a visitor access service and with an identity provider STS for a visitor organization.

FIG. 8 illustrates a high level logic flowchart depicting a process and program for managing identity provider authentication by a resource STS with an electronic trust relationship with a visitor access service and with an identity provider STS for a visitor organization. As illustrated, the process starts at block 800 and thereafter proceeds to block 802. Block 802 illustrates a determination whether a resource STS receives a request for access for a selected visitor organization from a visitor interface with a trust relationship with the resource STS. If the resource STS receives a request for access for a selected visitor organization from a visitor interface with a trust relationship with the resource STS, then the process passes to block 804.

Block 804 depicts identifying the identity provider STS for the selected visitor organization, where there is an electronic trust relationship between the resource STS and the identity provider STS. Next, block 806 illustrates sending a message to the visitor interface to redirect the access to request to the identified identity provider STS. Thereafter, block 808 depicts a determination whether the resource STS receives an ID-token validation request from a visitor interface. If the resource STS receives the ID-token validation request from the visitor interface, then the process passes to block 810. Block 810 illustrates a determination whether the resource STS is able to authenticate the ID-token as received from the identity provider STS. If the resource STS authenticates the ID-token, then the process passes to block 812. Block 812 depicts issuing an R-token to the visitor interface authenticating the ID-token, and the process ends.

Although not depicted, at block 808 or 810, if the resource STS does not receive a particular message or cannot authenticate the ID-token after a timeout period or the resource STS receives an error message or other message, then the process may control output of an error message and end or return to block 802.

Figure 9:
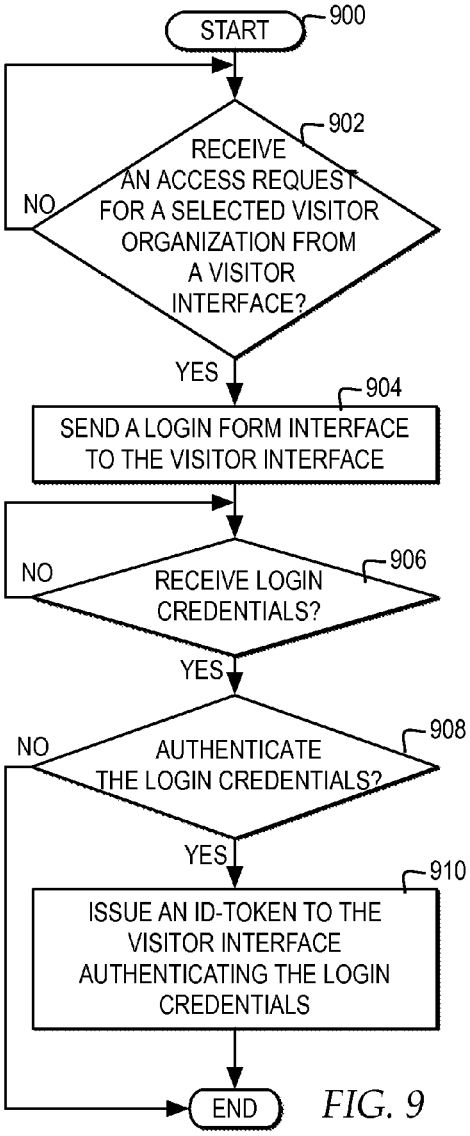
FIG. 9 illustrates a high level logic flowchart of a process and program for managing identity authentication by an identity provider STS for a visitor organization with an electronic trust relationship with a resource STS for a host organization.

FIG. 9 illustrates a high level logic flowchart depicting a process and program for managing identity authentication by an identity provider STS for a visitor organization with an electronic trust relationship with a resource STS for a host organization. As illustrated, the process starts at block 900 and thereafter proceeds to block 902. Block 902 illustrates a determination whether an identity provider STS receives a request for access for a selected visitor organization from a visitor interface. If the identity provider STS receives a request for access for a selected visitor organization from a visitor interface, then the process passes to block 904. Block 904 illustrates sending a login form interface to the visitor interface. Next, block 906 depicts a determination whether the identity provider STS receives login credentials from the visitor interface. If the identity provider STS receives login credentials from the visitor interface, then the process passes to block 908. Block 908 illustrates a determination whether the identity provider STS is able to authenticate the login credentials for a particular electronic identity account from among the electronic identity accounts managed by the identity provider STS. If the identity provider STS is able to authenticate the login credentials for a particular electronic identity account, then the process passes to block 910. Block 910 depicts the identity provider STS issuing an ID-token authenticating the login credentials to the visitor interface, and the process ends.

Although not depicted at block 906 or 908, if the identity provider STS does not receive a particular message or cannot authenticate the credentials after a timeout period or the identity provider STS receives an error message or other message, then the process may control output of an error message and end or return to block 902.

Figure 10:
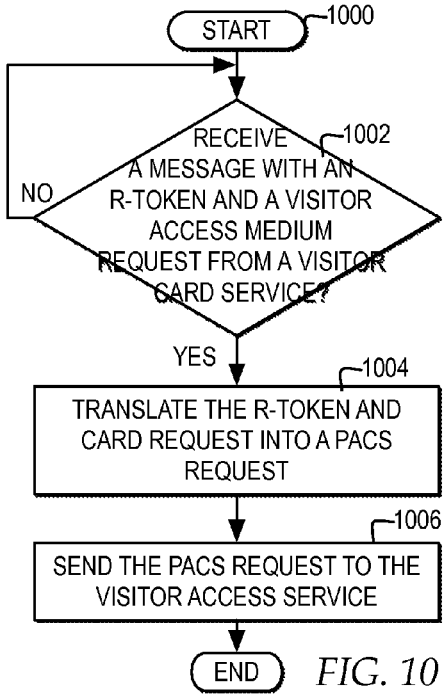
FIG. 10 illustrates a high level logic flowchart of a process and program for managing a translator service for translating an authenticated identity token and a visitor access medium request into a PACS request for an existing PACS system.

FIG. 10 illustrates a high level logic flowchart depicting a process and program for managing a translator service for translating an authenticated identity token and visitor access medium request into a PACS request for an existing PACS system. As illustrated the process starts at block 1000 and thereafter proceeds to block 1002. Block 1002 illustrates a determination whether a translator service receive a message with an R-token, including an authenticated identity for a visitor and an authentication of the identity provider for the visitor organization authenticating the visitor identity, and additional visitor access medium request information, from a visitor access service. If the translator service receives the message with an R-token and request information, then the process passes to block 1004. Block 1004 depicts translating the R-token and visitor access medium request into a PACS request for the existing PACS system. Next, block 1006 illustrates sending the PACS request to the visitor access service, and the process ends.

Figure 11:
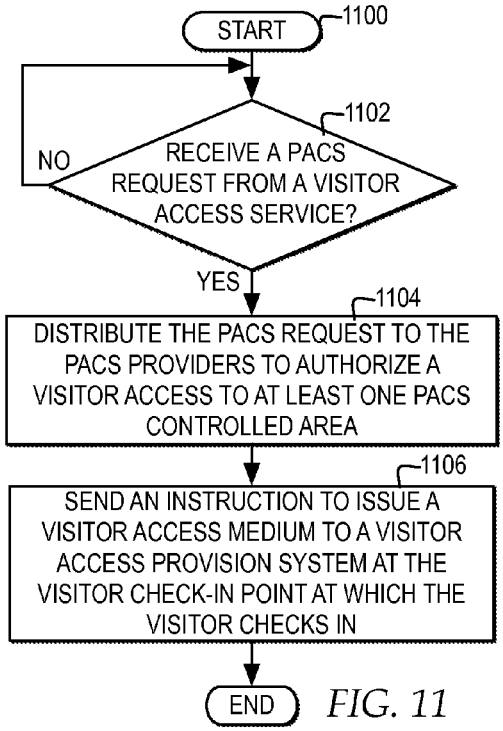
FIG. 11 illustrates a high level logic flowchart of a process and program for managing a PACS visitor provision service providing an interface between a visitor access service and a PACS system.

FIG. 11 illustrates a high level logic flowchart depicting a process and program for managing a PACS visitor provision service providing an interface between a visitor access service and a PACS system. As illustrated, the process starts at block 1100 and thereafter proceeds to block 1102. Block 1102 illustrates a determination whether a PACS visitor provision service receives a PACS request from a visitor access service. If a PACS visitor provision service receives a PACS request from a visitor access service, then the process passes to block 1104. Block 1104 illustrates distributing the PACS request to the PACS provider systems to authorize a visitor access to at least one PACS controlled area. Next, block 1106 depicts sending an instruction to issue a visitor access medium for the visitor to a visitor access provision system at the visitor check-in point where a visitor is checking in and requesting access to a host physical site, and the process ends.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, occur substantially concurrently, or the blocks may sometimes occur in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification specify the presence of stated features, integers, steps, operations, elements, and/or components, but not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the one or more embodiments of the invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

While the invention has been particularly shown and described with reference to one or more embodiments, it will be understood by those skilled in the art that various changes in form and detail may be made therein without departing from the spirit and scope of the invention.

What is claimed is:

1. A method of issuing a visitor access medium to a visitor for access to a visitor access medium controlled physical site of a host organization, comprising:

receiving, by at least one processor of a host organization system for a host organization of a physical site, a request, by a visitor with an identifier of a visitor organization, for a visitor access medium for access to the physical site controlled by a physical access control system requiring presentation of the visitor access medium for access to the physical site, wherein there is an electronic trust relationship according to a federation standard between the host organization system and a visitor organization system for the visitor organization via a network, wherein the visitor organization system maintains an electronic identity profile for the visitor comprising authentication information for the visitor organization system to authenticate the identity of the visitor according to the federation standard, wherein the host organization system does not separately maintain information for authenticating the identity of the visitor;

identifying, by the at least one processor, the visitor organization system from among a plurality of visitor organization systems with which the host organization system maintains separate electronic trust relationships according to the federation standard;

sending, by the at least one processor, a request to the visitor organization system to provide access to the visitor;

receiving, by the at least one processor, a login interface for the visitor from the visitor organization system;

outputting, by the at least one processor, the login interface for the visitor to enter identifying information;

sending, by the at least one processor, the identifying information input by the visitor through the login interface to the visitor organization system according to the federation standard;

receiving, by the at least one processor, an identity provider token dispensed by the visitor organization system according to the federation standard identifying the identity of the visitor is verified by the visitor organization system from the identifying information authenticating in the electronic identity profile for the visitor;

responsive to validating the identity provider token is from the visitor organization system, dispensing, by the at least one processor, a resource token from the host organization system according to the federation standard validating the identity of the visitor by the visitor organization system, wherein at least one assertion in the identity provider token authenticating the identity of the visitor is copied into the resource token, wherein the host organization system implements the authentication process through the existing electronic trust relationship with the visitor organization system to generate the resource token to authenticate the visitor for access to both the electronic services of the host organization system and for access to the physical site;

translating, by the at least one processor, data in the resource token specified according to the federation standard into a physical access control system request for the visitor access medium formatted for calling a physical access control system application programming interface; and sending, by a visitor access service of the host organization system, the physical access control system request to a visitor provision service interface layer atop a physical access control system to call the physical access control system application program interface, for adding the visitor to the physical access control system and triggering issuance of the visitor access medium for the visitor, wherein the visitor provision service layer provides an interface between the host organization system and the physical access control system, wherein the visitor provision service layer distributes the physical access control system request to at least one physical access control system provider comprising the physical access control system application program interface of the physical access control system, wherein each physical access control system provider provisions access by the visitor using the physical visitor access medium by each of a plurality of door controllers for controlling access to the physical site.

2. The method according to claim 1, where receiving, by at least one processor of a host organization system for a host organization of the physical site, a request by a visitor with an identifier of a visitor organization for a visitor access medium for access to the physical site controlled by a physical access control system requiring presentation of the visitor access medium for access to the physical site, further comprises:

receiving, by the at least one processor, the request by the visitor physically present at a visitor check-in point of the physical site through a browser window of the visitor check-in point.

3. The method according to claim 1, wherein receiving, by the at least one processor, an identity provider token dispensed by the visitor organization system according to the federation standard identifying the identity of the visitor is verified by the visitor organization system from the identifying information authenticating in the electronic identity profile for the visitor, further comprises:

responsive to a visitor interface of the host organization system receiving the identity provider token, redirecting the identity provider token from the visitor interface to a resource secure token service of the host organization system; and responsive to the resource secure token service receiving the identity provider token, validating the identity provider token by authenticating that an identity provider secure token service of the visitor organization system sent the identity provider token according to the federation standard.

4. The method according to claim 1, wherein receiving, by at least one processor of a host organization system for a host organization of the physical site, a request by a visitor with an identifier of a visitor organization for a visitor access medium for access to the physical site controlled by a physical access control system requiring presentation of the visitor access medium for access to the physical site, wherein there is an electronic trust relationship according to a federation standard between the host organization system and a visitor organization system for the visitor organization via a network, wherein the visitor organization system maintains an electronic identity profile for the visitor, further comprises:

establishing the electronic trust relationship between the host organization system and the visitor organization system under the federation standard comprising a WS-Federation protocol.

5. The method according to claim 1, wherein sending, by a visitor access service of the host organization system, the physical access control system request to a visitor provision service interface layer atop a physical access control system to call the physical access control system application program interface, for adding the visitor to the physical access control system and triggering issuance of the visitor access medium for the visitor, wherein the visitor provision service layer provides an interface between the host organization system and the physical access control system, wherein the visitor provision service layer distributes the physical access control system request to at least one physical access control system provider comprising the physical access control system application program interface of the physical access control system, wherein each physical access control system provider provisions access by the visitor using the physical visitor access medium by each of a plurality of door controllers, further comprises:

sending by the visitor provision service interface layer of the host organization system, an instruction to issue the visitor access medium to a particular physical access provision system provider of the host organizations system at a visitor check-in point of the host organization system receiving the request by the visitor; and outputting, by the particular physical access provision system provider, a physical visitor access medium specified in the instruction.

6. A system for issuing a visitor access medium to a visitor for access to a visitor access medium controlled physical site of a host organization, comprising:

one or more processors;

a host organization system, for execution by at least one of said one or more processors, operative to receive, for a host organization of a physical site, a request, by a visitor with an identifier of a visitor organization, for a visitor access medium for access to the physical site controlled by a physical access control system requiring presentation of the visitor access medium for access to the physical site, wherein there is an electronic trust relationship according to a federation standard between the host organization system and a visitor organization system for the visitor organization via a network, wherein the visitor organization system maintains an electronic identity profile for the visitor comprising authentication information for the visitor organization system to authenticate the identity of the visitor according to the federation standard, wherein the host organization system does not separately maintain information for authenticating the identity of the visitor;

the host organization system operative to identify the visitor organization system from among a plurality of visitor organization systems with which the host organization system maintains separate electronic trust relationships according to the federation standard;

the host organization system operative to send a request to the visitor organization system to provide access to the visitor;

the host organization system operative to receive a login interface for the visitor from the visitor organization system;

the host organization system operative to output the login interface for the visitor to enter identifying information;

the host organization system operative to send the identifying information input by the visitor through the login interface to the visitor organization system according to the federation standard;

the host organization system operative to receive an identity provider token dispensed by the visitor organization system according to the federation standard identifying the identity of the visitor is verified by the visitor organization system from the identifying information authenticating in the electronic identity profile for the visitor;

the host organization system, responsive to validating the identity provider token is from the visitor organization system, operative to dispense a resource token from the host organization system according to the federation standard validating the identity of the visitor by the visitor organization system, wherein at least one assertion in the identity provider token authenticating the identity of the visitor is copied into the resource token, wherein the host organization system implements the authentication process through the existing electronic trust relationship with the visitor organization system to generate the resource token to authenticate the visitor for access to both the electronic services of the host organization system and for access to the physical site;

the host organization system, operative to translate data in the resource token specified according to the federation standard into a physical access control system request for the visitor access medium formatted for calling a physical access control system application programming interface; and the host organization system, operative to send, by a visitor access service of the host organization system, the physical access control system request to a visitor provision service interface layer atop a physical access control system to call the physical access control system application program interface, for adding the visitor to the physical access control system and triggering issuance of the visitor access medium for the visitor, wherein the visitor provision service layer provides an interface between the host organization system and the physical access control system, wherein the visitor provision service layer distributes the physical access control system request to at least one physical access control system provider comprising the physical access control system application program interface of the physical access control system, wherein each physical access control system provider provisions access by the visitor using the physical visitor access medium by each of a plurality of door controllers for controlling access to the physical site.

7. The system according to claim 6, where the host organization system operative to receive a request by a visitor with an identifier of a visitor organization for a visitor access medium for access to the physical site controlled by a physical access control system requiring presentation of the visitor access medium for access to the physical site, further comprises:

the host organization system operative to receive the request by the visitor physically present at a visitor check-in point of the physical site through a browser window of the visitor check-in point.

8. The system according to claim 6, wherein the host organization system operative to receive an identity provider token dispensed by the visitor organization system according to the federation standard identifying the identity of the visitor is verified by the visitor organization system from the identifying information authenticating in the electronic identity profile for the visitor, further comprises:

the host organization system, responsive to a visitor interface of the host organization system receiving the identity provider token, operative to redirect the identity provider token from the visitor interface to a resource secure token service of the host organization system; and the host organization system, responsive to the resource secure token service receiving the identity provider token, operative to validate the identity provider token by authenticating that an identity provider secure token service of the visitor organization system sent the identity provider token according to the federation standard.

9. The system according to claim 6, wherein a host organization system, operative to receive, for a host organization of the physical site, a request by a visitor with an identifier of a visitor organization for a visitor access medium for access to the physical site controlled by a physical access control system requiring presentation of the visitor access medium for access to the physical site, wherein there is an electronic trust relationship according to the federation standard between the host organization system and a visitor organization system for the visitor organization via a network, wherein the visitor organization system maintains an electronic identity profile for the visitor, further comprises:

the host organization system operative to establish the electronic trust relationship between the host organization system and the visitor organization system under the federation standard comprising a WS-Federation protocol.

10. The system according to claim 6, wherein the host organization system, operative to send, by a visitor access service of the host organization system, the physical access control system request to a visitor provision service interface layer atop a physical access control system to call the physical access control system application program interface, for adding the visitor to the physical access control system and triggering issuance of the visitor access medium for the visitor, wherein the visitor provision service layer provides an interface between the host organization system and the physical access control system, wherein the visitor provision service layer distributes the physical access control system request to at least one physical access control system provider comprising the physical access control system application program interface of the physical access control system, wherein each physical access control system provider provisions access by the visitor using the physical visitor access medium by each of a plurality of door controllers, further comprises:

the visitor provision service interface layer of the host organization system operative to send an instruction to issue the visitor access medium to a particular physical access provision system provider of the host organizations system at a visitor check-in point of the host organization system receiving the request by the visitor; and the particular physical access provision system provider operative to output a physical visitor access medium specified in the instruction.

11. A computer program product for issuing a visitor access medium to a visitor for access to a visitor access medium controlled physical site of a host organization, comprising:

one or more computer-readable, tangible non-transitory storage devices;

program instructions, stored on at least one of the one or more storage devices to receive, for a host organization system of a host organization of a physical site, a request, by a visitor with an identifier of a visitor organization, for a visitor access medium for access to the physical site controlled by a physical access control system requiring presentation of the visitor access medium for access to the physical site, wherein there is an electronic trust relationship according to a federation standard between the host organization system and a visitor organization system for the visitor organization via a network, wherein the visitor organization system maintains an electronic identity profile for the visitor comprising authentication information for the visitor organization system to authenticate the identity of the visitor according to the federation standard, wherein the host organization system does not separately maintain information for authenticating the identity of the visitor;

program instructions, stored on at least one of the one or more storage devices to identify the visitor organization system from among a plurality of visitor organization systems with which the host organization system maintains separate electronic trust relationships according to the federation standard;

program instructions, stored on at least one of the one or more storage devices to send a request to the visitor organization system to provide access to the visitor;

program instructions, stored on at least one of the one or more storage devices to receive a login interface for the visitor from the visitor organization system;

program instructions, stored on at least one of the one or more storage devices to output the login interface for the visitor to enter identifying information;

program instructions, stored on at least one of the one or more storage devices to send the identifying information input by the visitor through the login interface to the visitor organization system according to the federation standard;

program instructions, stored on at least one of the one or more storage devices to receive an identity provider token dispensed by the visitor organization system according to the federation standard identifying the identity of the visitor is verified by the visitor organization system from the identifying information authenticating in the electronic identity profile for the visitor, program instructions, stored on at least one of the one or more storage devices, responsive to validating the identity provider token is from the visitor organization system, to dispense a resource token from the host organization system according to the federation standard validating the identity of the visitor by the visitor organization system, wherein at least one assertion in the identity provider token authenticating the identity of the visitor is copied into the resource token, wherein the host organization system implements the authentication process through the existing electronic trust relationship with the visitor organization system to generate the resource token to authenticate the visitor for access to both the electronic services of the host organization system and for access to the physical site;

program instructions, stored on at least one of the one or more storage devices to translate data in the resource token specified according to the federation standard into a physical access control system request for the visitor access medium formatted for calling a physical access control system application programming interface; and program instructions, stored on at least one of the one or more storage devices to send the physical access control system request to a visitor provision service interface layer atop a physical access control system to call the physical access control system application program interface, for adding the visitor to the physical access control system and triggering issuance of the visitor access medium for the visitor, wherein the visitor provision service layer provides an interface between the host organization system and the physical access control system, wherein the visitor provision service layer distributes the physical access control system request to at least one physical access control system provider comprising the physical access control system application program interface of the physical access control system, wherein each physical access control system provider provisions access by the visitor using the physical visitor access medium by each of a plurality of door controllers for controlling access to the physical site.

12. The computer program product according to claim 11, further comprising:

program instructions, stored on at least one of the one or more storage devices to receive the request by the visitor physically present at a visitor check-in point of the physical site through a browser window of the visitor check-in point.

13. The computer program product according to claim 11, further comprising:

program instructions, stored on at least one of the one or more storage devices, responsive to a visitor interface of the host organization system receiving the identity provider token, to redirect the identity provider token from the visitor interface to a resource secure token service of the host organization system; and program instructions, stored on at least one of the one or more storage devices, responsive to the resource secure token service receiving the identity provider token, to validate the identity provider token by authenticating that an identity provider secure token service of the visitor organization system sent the identity provider token according to the federation standard.

14. The computer program product according to claim 11, further comprising:

program instructions, stored on at least one of the one or more storage devices to send an instruction to issue the visitor access medium to a particular physical access provision system provider of the host organizations system at a visitor check-in point of the host organization system receiving the request by the visitor; and program instructions, stored on at least one of the one or more storage devices to control output of a physical visitor access medium specified in the instruction.

* * * * *